US005180705A

United States Patent [19]

Smith et al.

[11] Patent Number: 5,180,705

[45] Date of Patent: Jan. 19, 1993

[54] TRANSFER IMAGING USING METAL-AZO AND METAL-AZOMETHINE DYES

[75] Inventors: Terrance P. Smith; David W. Macomber; Jeffrey C. Chang; Linda K. Williams, all of St. Paul, Minn.

[73] Assignee: Minnesota Mining and Manufacturing Company, Saint Paul, Minn.

[21] Appl. No.: 667,323

[22] Filed: Mar. 11, 1991

[51] Int. Cl.[5] ..... B41M 5/035; B41M 5/38

[52] U.S. Cl. ..... 503/227; 428/195; 428/211; 428/480; 428/913; 428/914

[58] Field of Search ..... 8/471; 428/195, 913, 428/914, 211, 480; 503/227

[56] References Cited

U.S. PATENT DOCUMENTS

| | | | |
|---|---|---|---|
| 3,765,814 | 9/1973 | Bedell | 96/3 |
| 4,218,367 | 8/1980 | Brouard et al. | 260/146 |
| 4,605,607 | 8/1986 | Nikles et al. | 430/17 |
| 5,084,435 | 1/1992 | Vanmaele et al. | 503/227 |

OTHER PUBLICATIONS

Copending U.S. application Serial No. 07/667,658 filed Mar. 11, 1991 entitled "Polymerizable Metal-Azo and Metal-Azomethine Dyes".

"A Novel Concept of dye Application for Dying and Printing," Gulbins et al., JSDC, Dec. 1965.

*Primary Examiner*—B. Hamilton Hess

[57] ABSTRACT

Dye donor sheets comprising a substrate having a coating comprising a binder and at least one neutral 1:1 metal-azo or neutral 1:1 metal-azomethine dye having the general structure:

wherein $Z_1$ and $Z_2$ each independently represent an arene nucleus, having from 5 to 14 ring atoms;

$G_1$ and $G_2$ each independently represent a metal ligating group, and further wherein $G_1$ and $G_2$ may be contained within or pendant from at least one of $Z_1$ and $Z_2$;

R represents a hydrogen atom, a halogen atom, an alkyl group, an acylamino group, an alkoxy group, a sulfonamido group, an aryl group, a thiol group, an alkylthio group, an arylthio group, an alkylamino group, an arylamino group, an amino group, an alkoxycarbonyl group, an acyloxy group, a nitro group, a cyano group, a sulfonyl group, a sulfoxyl group, an aryloxy group, a hydroxy group, a thioamido group, a carbamoyl group, a sulfamoyl group, a carboxyl group, a sulfo group, a formyl group, an acyl group, a ureido group, or aryloxycarbonyl group, a silyl group, a carbonato group, or a sulfoalkoxy group;

L is any combination of monodentate, bidentate, or tridentate ligands which satisfy the coordination requirements of the metal;

X represents nitrogen or a methine (CH) group;

M is a divalent or polyvalent transition metal where the coordination number is at least four; and k, m, and n are whole numbers less than or equal to 3.

Use of the above constructions in thermal dye transfer imaging is also disclosed.

12 Claims, No Drawings

TRANSFER IMAGING USING METAL-AZO AND METAL-AZOMETHINE DYES

FIELD OF THE INVENTION

This invention relates to thermal imaging and, more particularly, to a dye donor element with metal-azo and metal-azomethine complexes.

BACKGROUND OF THE INVENTION

The term thermal printing covers two main technology areas. In thermal transfer printing of textiles, a donor sheet is coated with a pattern of one or more dyes, contacted with the fabric to be printed, and heat is uniformly administered, sometimes with concomitant application of a vacuum. The transfer process has been much studied, and it is generally accepted that the dyes are transferred by sublimation in the vapor phase. Pertinent references include: Bent, C. J. J. Soc. Dyers Colour. 1969, 85, 606; Griffiths, J.; Jones, F. Ibid. 1977, 93, 176; Aihara J. Am. Dyest. Rep. 1975, 64, 46; Vellins, C. E. In The Chemistry of Synthetic Dyes; Venkataraman, K., Ed.; Academic Press: New York, 1978; Vol. 8, p 191.

The other area of thermal printing is thermal imaging, where heat is applied in an image-wise fashion to a donor sheet in contact with a suitable receptor sheet to form a colored image on the receptor. In one embodiment, termed thermal mass transfer printing, as described for instance in U.S. Pat. No. 3,898,086, the donor is a colorant dispersed in a wax-containing coating. On the application of heat the construction melts or is softened, and a portion of the colored donor coating transfers to the receptor. Despite problems with transparency, pigments are generally the colorants of choice in order to provide sufficient light fastness of the colored image on the receptor.

Another embodiment is termed variously thermal transfer imaging or recording, or dye diffusion thermal transfer. In this case, the donor sheet comprises a dye in a binder. On image-wise application of heat, the dye, but not the binder, is transferred to the receptor sheet. A recent review has described the transfer mechanism as a "melt state" diffusion process quite distinct from the sublimation attending textile printing (Gregory, P. Chem. Brit. 1989, 25, 47). This same review emphasizes the great difficulty of developing dyes suitable for diffusive thermal transfer. With regard to the available conventional dyes, it was stated that ". . . It is significant that of the one million or so dyes available in the world, none of them were fully satisfactory . . . ". Among the failings of these dyes are inadequate light and heat fastness of the image and insufficient solubility of the dyes for coating in the donor sheet. As has been noted previously, light fastness is also a problem in mass transfer imaging systems. In fact, achieving adequate light fastness is probably the single most important challenge in these constructions. In large measure this is the result of the diffusive thermal transfer dye image being a surface coating a few microns thick. The dye is thus readily susceptible to degradation by photo-oxidation. In contrast, textile fibers, which are 100 times thicker, are uniformly dyed throughout their depth, so that fade in the first few microns at the surface is of little practical importance. In consequence, it is common to find that dyes showing good light fastness in textile printing exhibit very poor photostability in the diffusive thermal imaging (see, for example U.S. Pat. No. 4,808,568).

There remains, therefore, a strong need for improved dyes for this latter application.

Metal-azo dyes, having one dye to one metal, are known in the art. The following references discuss the preparation of these materials: Drew, H. D. K.; Fairbairn, R. E. J. Chem. Soc. 1939, 823–835; Beech, W. F.; Drew, H. D. K. J. Chem. Soc. 1940, 608–612; Steiner, E.; Mayer, C.; Schetty, G. Helv. Chim. Acta. 1976, 59, 364–376; U.S. Pat. Nos. 4,012,369; 4,123,429; and 4,265,811. Metal-azo 1:1 complexes are predominantly used in two applications, color photography and the dyeing of textiles.

The following are examples of the use of 1:1 complexes in the photographic field: U.S. Pat. Nos. 3,453,107; 3,551,406; 3,544,545; 3,563,739; 3,597,200; 3,705,184; 3,752,836; 3,970,616; 4,150,018; 4,562,139; and 4,767,698. One embodiment of color photography, termed color diffusion transfer photography, employs non-diffusible, dye releasing compounds which are 1:1 complexes. In this embodiment, a ballasted carrier moiety, capable of releasing the dye as a function of development of the silver halide emulsion layer under alkaline conditions, is incorporated into the metal-complex. The 1:1 complex then diffuses through gelatin to a receiving element. The constructions require the presence of a silver halide emulsion layer and a "ballasting" group covalently attached to the metal-complex. Chemistry is required in order to create a diffusible moiety.

The following references are to 1:1 complexes used in textile dyeing: U.S. Pat. Nos. 3,878,158; 4,218,367; 4,617,382; and European Pat. 144776.

For the most part, the 1:1 complexes discussed in the two preceding paragraphs are chromium(III) complexes containing a tridentate azo dye, a monoanionic bidentate ligand (e.g. acetylacetonate), and a monofunctional monodentate ligand. The monofunctional ligand is generally $H_2O$, although, examples where the ligand is pyridine, ammonia, or ethanolamine are also described.

Metal complexes containing polymerizable functionality are known. The metal vinylpyridines complexes are representative members of this class. Selected references to metal vinylpyridine complexes are: U.S. Pat. No. 3,287,455 and Agnew, N. H.; Collin, R. J.; Larkworthy, L. F. J. Chem. Soc., Dalton Trans. 1974, 272–277. For the most part, the color of these materials is due to weakly absorbing metal-centered ligand field transitions. Some cobalt(II) derivatives are reported to be deep blue (Agnew, N. H.; Larkworthy, L. F. J. Chem. Soc. 1965, 4669–71). The color in these systems is also due to metal-centered transitions, however, in a distorted tetrahedral environment. Generally, the extinction coefficients of visible wavelength transitions in these metal complexes are less than 1000 $M^{-1}$ $cm^{-1}$ which make them, in general, unsuitable as dyes or colorants.

Many transition metal complexes with vinylpyridine as a ligand are unstable. Some of these complexes are quite labile in solution, exhibiting the following equilibrium:

$$M(\text{ligand})_x(\text{vinylpyridine})_n \rightleftharpoons M(\text{ligand})_x(\text{vinylpyridine})_{n-1} + \text{vinylpyridine}$$

Additionally, transition metals, such as copper(II) and ruthenium(III), may initiate the polymerization of vinylpyridine (e.g., Tazuke, S.; Okamura, S. J. Polym. Sci.: Part A-1 1966, 4, 141–57 and Norton, K. A., Jr.;

Hurst, J. K. J. Am. Chem. Soc. 1978, 100, 7237–42), although some stable complexes of copper(II) and vinylpyridine have been reported (Laing, M.; Horsfield, E. J. Chem. Soc., Chem. Commun. 1968, 735).

These examples demonstrate the complexity of predicting the stability of metal complexes containing polymerizable groups. There are still other examples where the vinyl group undergoes a cyclometallation reaction with the metal (Newkome, G. R; Theriot, K. J.; Cheskin, B. K.; Evans, D. W.; Baker, G. R. Organometallics 1990, 9, 1375–9.

There is very little reference to the use of metal-azo dyes in thermal printing art. A review on transfer printing (Datye, K. V.; Vaidya, A. A. Chemical Processing of Synthetic Fibers and Blends; John Wiley & Sons: 1984, p 407) states: "Acid and metal-complex dyes which are commonly used for dyeing nylon are unsuitable for heat-transfer printing because these dyes have high melting points and low vapor pressures and hence, do not get vaporized and transferred below 200° C. However, the recently developed Dew Print TM machine enables wet-transfer printing of the acid and metal-complex dyes on nylon." The wet-transfer-process dyes of the above reference require the presence of water solubilizing groups such as sulfo and carboxy, and the dyes are generally charged. This process involves the dissolution of the dye in water and transfer to the substrate. Further details of this process are given in U.S. Pat. No. 4,155,707.

Metal-azo dyes have been used in mass transfer printing. In Japanese Pat. No. 62021594-A, it is stated that "the ink layer is completely transferred to plain paper when the transfer recorder is peeled from plain paper'-'—a clear indication that both the binder and the colorant are transferred. Moreover, the binders used in the practical examples are all low molecular weight (less than 2000 Daltons), except for the control which was demonstrated to not transfer efficiently. The colorants used were high melting pigments, some of which were calcium or sodium salts of azo dyes. These salts are ionic in nature and are generally not soluble in organic solvents. In a related case (Japanese Pat. No. 62021593-A) the process being discussed is also mass transfer, however, the colorants were "oil soluble". Some of these oil soluble dyes were metal-azo dyes, wherein the structures were not explicitly disclosed. The metal-azo dyes that could be identified were found to be negatively charged 2:1 (metal:azo) complexes. The solubility characteristics of the dyes, for which structures were not available, indicate that they are probably 2:1 complexes, as well.

Other embodiments of mass transfer systems utilizing metal-azo dyes are discussed in U.S. Pat. Nos. 4,585,688, 4,664,670, and 4,784,905. Described in U.S. Pat. No. 4,585,688 is a transfer medium comprised of a heat-resistive support, a colorant layer containing a binder and a coloring agent (which may be a metal-azo dye) and a transferrable layer comprising a low molecular weight compound capable of containing a coloring agent and transferring an image to a paper receptor. In U.S. Pat. No. 4,664,670, a thermal transfer donor construction requiring the presence of a low melting, essentially colorless, non-polymeric, organic nitrogen-containing, impregnating reagent for the printing of textiles is disclosed. A thermosensitive image transfer recording medium comprised of a support material and a thermofusible ink layer is described in U.S. Pat. No. 4,784,905. The thermofusible ink layer contains a fine porous resin structure made of a resin containing: (1) a coloring agent (which may be a metal-azo or metal-azomethine dye), (2) a carrier material (for holding the coloring agent at normal temperatures and also for carrying the coloring agent out of the thermofusible ink layer for image formation upon application of heat), and (3) an image gradation control agent.

There are also several published patent applications (see, for example: Japanese Publ. Appl. Pat. Nos. 63-144,084, 60-002,398, and 59-078,893-A) which disclose the use of metallizable azo dyes in thermal transfer donor constructions. In these cases, the donor layer comprises an azo dye, capable of chelating to a metal, and a binder. The azo dye is thermally transferred to a receptor layer which contains a metal salt which can react with the azo dye. The generation of a metal-azo dye by this method has several potential drawbacks because (1) the colors of the azo dyes and the metallized dye are different, the resultant color will depend on the extent of metallization, (2) metallized dyes are generally much more resistant to light induced fade and therefore, if both azo dye and metallized-azo dye are present the color may change as a function of light exposure, (3) the chelation of the azo dye to a metal often involves the generation of acid which could have a deleterious effect on image stability. This problem can be overcome by addition of buffering agents, however, this further complicates the donor or the receptor formulation.

SUMMARY OF THE INVENTION

The present invention provides a dye-donor sheet comprising a substrate having a coating comprising polymeric binder and at least one neutral 1:1 metal-azo or neutral 1:1 metal azo-methine dye complex, the neutral metal-dye complex having the general structure:

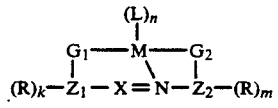

wherein $Z_1$ and $Z_2$ each independently represents an arene nucleus having 5 to 14 ring atoms;

$G_1$ and $G_2$ each independently represent a metal ligating group, and further wherein $G_1$ and $G_2$ may be contained within or pendant from at least one of $Z_1$ and $Z_2$;

R represents a hydrogen atom, a halogen atom, an alkyl group, an acylamino group, an alkoxy group, a sulfonamido group, an aryl group, a thiol group, an alkylthio group, an arylthio group, an alkylamino group, an arylamino group, an amino group, an alkoxycarbonyl group, an acyloxy group, a nitro group, a cyano group, a sulfonyl group, a sulfoxyl group, an aryloxy group, a hydroxy group, a thioamido group, a carbamoyl group, a sulfamoyl group, a carboxyl group, a sulfo group, a formyl group, an acyl group, a ureido group, or aryloxycarbonyl group, a silyl group, a carbonato group, or a sulfoalkoxy group;

L is any combination of monodentate, bidentate, or tridentate ligands which satisfy the coordination requirements of the metal;

X represents nitrogen or a methine (CH) group;

M is a divalent or polyvalent transition metal where the coordination number is at least 4; and k, m, and n are whole numbers less than or equal to 3.

This invention provides dye donor elements which, when heated in an image-wise fashion, result in the image-wise transfer of dye to a receptor sheet. The resulting dye images have good light and heat fastness. The present invention is advantageous over prior art constructions because only the application of heat is necessary to transfer the dye and additionally, the presence of a "ballasting" group covalently bonded to the metal-dye complex is neither necessary or desirable.

DETAILED DESCRIPTION OF THE INVENTION

The dye-donor element of the invention comprises a substrate having a coating comprising polymeric binder and at least neutral one 1:1 metal-azo or neutral 1:1 metal-azomethine dye. The ratio of metal-to-dye must be 1:1. Neutral 1:1 Metal-azo and 1:1 metal-azomethine dyes of the present invention have the general structure:

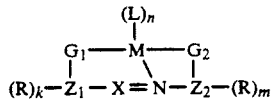

wherein:

$Z_1$ and $Z_2$ each independently represent an arene nucleus, wherein $Z_1$ and $Z_2$ have from 5 to 14 ring atoms; for example $Z_1$ and $Z_2$ may represent a heterocyclic or substituted heterocyclic nucleus (e.g., pyrrole, pyrazole, furan, indole, thiophene, etc.), or substituted ketomethine groups (e.g., acetoacetanilides, α-cyanocarbonyls). As used herein, the term "arene nucleus" means a nucleus containing at least one aromatic ring, e.g., benzene or napthalene.

$G_1$ and $G_2$ each independently represent a metal ligating group (e.g., oxygen, sulfur, amines, substituted amines, acylamido, sulfonamido), and further wherein $G_1$ and $G_2$ may be contained within or pendant from at least one of $Z_1$ and $Z_2$. $G_1$ and $G_2$ in the above formula could represent, for example, any metal chelating group as long as it performs the desired function of coordination with the metal. The above metal chelate can be formed with loss of a proton from a conjugate acid, thereby forming a conjugate base, or by sharing a pair of electrons with the metal. In the preferred embodiment, $G_1$ and $G_2$ independently represent hydroxy, carboxy, or a nitrogen atom which is part of $Z_1$ and $Z_2$.

R represents a hydrogen atom, a halogen atom, an alkyl group (e.g., a methyl group, ethyl group, hexyl group, etc.), an acylamino group (e.g., an acetamido group, benzamido group, hexanamido group, etc.), an alkoxy group (e.g., methoxy group, ethoxy group, benzyloxy group, etc.), a sulfonamido group (e.g., a methanesulfonamido group, benzensulfonamido group, etc.), an aryl group (e.g., a phenyl group, a 4-chlorophenyl group, etc.), a thiol group, a alkylthio group (e.g., a methylthio, a butylthio group, etc.), an arylthio group (e.g., a phenylthio group, a 4-methoxyphenylthio group, etc.), an alkylamino group (e.g., a cyclohexylamino group, methylamino group, etc.), an arylamino group (e.g., an anilino group, a 4-methoxycarbonylamino group, a naphthylamino group, etc.), an amino group, an alkoxycarbonyl group (e.g., a methoxycarbonyl group, a butoxycarbonyl group, etc.), an acyloxy group (e.g., an acetoxy group, a butyryloxy group, a benzoyl group, etc.), a nitro group, a cyano group, a sulfonyl group (e.g., a butanesulfonyl group, a benzenesulfonyl group, etc.), a sulfoxyl group (e.g., a butanesulfoxyl group, a benzenesulfoxyl group, etc.), an aryloxy group (e.g., a phenoxy group, a naphthyloxy group, etc.), a hydroxy group, a thioamido group (e.g., butanethioamido group, a benzenethiocarbamoylamido group, etc.), a carbamoyl group (e.g., a carbamoyl group, an N-arylcarbamoyl group, an N-alkylcarbamoyl group, etc.), a sulfamoyl group, an N-arylsulfamoyl group, etc.), a carboxy group, a sulfo group, a formyl group, an acyl group (e.g., an acetyl group, a hexanoyl group, a benzoyl group, etc.) a ureido group (e.g., a ureido group, an N-ethylureido group, etc.), a aryloxycarbonyl group (e.g., a phenoxycarbonyl group, a 4-methoxycarbonyl group, etc.), a silyl group (e.g., a trimethylsilyl group, a phenyldimethylsilyl group, etc.), a carbonato group (e.g., a methylcarbonato group, a phenylcarbonato group, etc.), a sulfoalkoxy group (e.g., a sulfomethoxy group, a sulfophenoxy group, etc.).

L represents any combination of monodentate, bidentate, or tridentate ligands which satisfy the coordination requirements of the metal. L can be neutral or possess a formal negative charge. Representatives of these ligands can be found in Cotton, F. A.; Wilkinson, G. Advanced Inorganic Chemistry, 4th ed.; John Wiley & Sons: New York, 1980; pp 107–194. Suitable monodentate ligands L include water; ammonia; halides (e.g., fluoride, chloride, etc.); thiocyanate; cyanide (−1); azide (−1); carbon monoxide; alkyl- and aryl isocyanides (e.g., methylisocyanide, phenylisocyanide, etc.); alkyl and aryl nitriles (e.g., acetonitrile, benzonitrile, etc.); phosphines, $PR_3'$; amines, $NR_3'$; arsines, $AR_3'$; phosphites, $P(OR')_3$; sulfides R'SR' (wherein each R' independently represents an alkyl or aryl group); heteroarenes (e.g., pyridine, quinoline, etc.); nitrate (−1) or sulfate (−2). Preferably L is a nitrogen containing heterocycle or a tertiary phosphine, more preferably L is pyridine, a substituted pyridine, or imidazole. Examples of L include, but are not limited to, 4-ethylpyridine, 2-vinylpyridine, 3-vinylpyridine, 4-vinylpyridine, ethyl nicotinate, ethyl isonicotinate, 3-n-butylpyridine, 2-(3-pentenyl)pyridine, 1-vinylimidazole, or 3-(3-pyridyl)propyl methacrylate, etc. It is particularly preferred that L is a tertiary phosphine. Further examples of L include, but are not limited to trimethylphosphine, tri-n-butylphosphine, diphenylvinylphosphine, or triphenylphosphine. Suitable bidentate ligands L include bipyridine, acetylacetonato (−1), N,N-dialkyldithiocarbamato (−1), ethylenediamine, 8-hydroxyquinolato (−1), or diarylglyoximato (−2). For trivalent or higher valent metals, a preferred form of the invention is when L is a monoanionic, bidentate ligand; especially preferred are ligands based on acetylacetonates or 8-hydroxyquinolates. In another preferred embodiment, L is a combination of ligands such that the monodentate ligand contains a polymerizable group and the bidentate ligand is monoanionic and is derived by removing the acidic proton from either a β-diketone or a 8-hydroxyquinoline derivative. Suitable tridentate ligands L include terpyridines, diethylenetriamines, or trispyrazolylborates. X represents nitrogen or a methine (CH) group.

M is a divalent or polyvalent transition metal ion where the coordination number is at least four. Preferred metals are Group 6 and 11 metal ions. Particularly preferred metal ions are chromium (III), nickel (II), palladium (II), and platinum (II).

k, m, n, are whole number less than or equal to 3.

Additional substituents which may be attached to $Z_1$ and $Z_2$ include, but are not limited to, substituents such as alkyl, aryl, acyl, alkoxy, halogen such as fluorine or chlorine, cyano, nitro, thioalkyl, and solubilizing groups such as sulfonamido or sulfamoyl. Solubilizing groups R are preferred so as to make the dye compatible with a given solvent system or polymer. It is preferred that the dye be free of ionic, water-solubilizing groups such as sulfo or carboxy.

Where the terms "groups" or "nucleus" are used in describing substituents, substitution is anticipated on the substituent for example, alkyl group includes ether groups (e.g., $CH_3CH_2CH_2$—O—$CH_2$—), haloalkyls, nitroalkyls, carboxyalkyls, hydroxyalkyls, etc., whereas the term "alkyl" includes only hydrocarbons. Similarly, the term arene nucleus refers to not only phenyl, but chlorophenyl, ethylphenyl, and naphthyl as well. Substituents which react with active ingredients, such as very strong reducing or oxidizing substituents, would of course be excluded as not being inert or harmless.

The donor element may have a variety of structures, including a self-supporting entity or a laminate on various substrates, and may be used in a number of different imaging processes, including imaging with thermal print heads and with lasers.

The dye donor constructions of this invention provide transferred images which have good heat and light fastness.

The process of dye diffusion transfer consists of contacting a dye donor sheet with a suitable receptor sheet and applying heat in an image-wise fashion to transfer the dye to the receptor. Generally, the transfer involves temperatures in the range of 100° to 400° C. and a time of from about 1 to 10 milliseconds. In addition to providing an image of acceptable density and of correct color, the dye must provide good light fastness and heat stability in the image. It is particularly desirable that the dye transfers in proportion to the energy supplied, so that a good gray scale of coloration can be achieved.

The dye donor sheet for this process comprises a dye ink coated on a suitable substrate, though a self-sustaining dye film is also a possibility. The carrier sheet is preferably flexible, but may be rigid if the receptor layer is sufficiently flexible and/or conformable. The substrates may thus be glass, ceramic, metal, metal oxide, fibrous materials, paper, polymers, resins, and mixture or layers of these materials. For the backside thermal exposure with a thermal print head, examples include polyester, polyamide, polyamide, polyacrylate, polyalkylene and cellulosic films, and papers, especially the uniform high quality paper known as condenser paper. It may be desirable to apply a backside to the substrate on the side away from the dye to protect it from the heat source or to prevent sticking to the thermal element. The thickness of the resultant substrate may vary within wide limits depending on its thermal properties but is generally less than 50 microns, and is preferably less than 10 microns. If a front thermal exposure is used, for instance when a laser irradiates the dye through a transparent receptor sheet, the substrate may be of arbitrary thickness.

The dye ink applied to the donor sheet comprises a metal-azo or metal-azomethine dye as defined above, and a suitable binder. Other additives such as plasticizers, stabilizers, or surfactants may also be present, as it known in the art. Suitable binders are polymeric materials such as: polyvinyl chloride and its chlorinated derivatives; polyesters; celluloses, such as cellulose acetate, cellulose acetate butyrate, ethyl-cellulose and the like; epoxy resins; acrylates, such as poly(methyl methacrylate); vinyl resins, such as poly(vinyl acetate), poly(vinyl butyral), poly(vinyl pyrrolidone) and poly(vinyl alcohol); polyurethanes; polysiloxanes; copolymers, such as those derived from polyacrylates or polyalkylene materials; and blends or mixtures of these various polymers. The dye may be present in the binder in the dissolved state, or it may be dispersed with at least some crystalline dye present. In some cases as much as 99% by weight of the dye may be used, but more typically, the weight of dye is about 90% to 15% of the total ink layer. A preferred range is from 70% to 40% by weight of dye in the multilayer constructions. A self-supporting element may contain 20% by weight of the binder, and preferably as much as 40% by weight of the binder.

In general, it is desired to formulate the donor such that the dye, but substantially none of the donor element binder, is transferred to the receptor. However, in some cases valuable constructions can be prepared in which the dye along with a significant, or indeed major, portion of the binder is transferred in a mass transfer process. The receptor sheet may be transparent, translucent or opaque. It may be a single layer or a laminate. Particularly useful constructions can be made when the receptor is applied to a transparent polyester film or to a paper substrate.

The receptor sheet may comprise a wide variety of the polymers or their mixtures. Suitable materials are similar to those outlined above for the binder of the donor sheet. The receptor may additionally contain various additives, such as heat and light stabilizers or coating aids. While the exact nature of the receptor may influence the quality and the fastness of the image, it has been found that, for the most part, the good stability of the dyes of this invention is a property of the dye image itself, and not of the receptor composition.

The object of providing stable thermally transferred dye images is achieved in this invention by use of at least one metal-azo or metal-azomethine dye within the donor sheet. The metal-containing dyes of this invention are neutral, 1:1 complexes. It is preferred, that the dye be free of ionic, water-solubilizing groups such as sulfo and carboxy other than those attached to the metal center.

The following non-limiting examples further illustrate the present invention.

EXAMPLES

The following is a description of the various coating formulations referred to in the examples of this patent. All dye donor sheets were coated with a number 8 wire-wound coating rod (0.72 mil wet thickness) onto 5.7 micron Teijin F22G polyester film (Teijin Ltd., Tokyo, Japan), and dried in a current of air at ambient temperature. With the exception of commercially available dye receptor sheets, all receptor sheets were extrusion coated onto 4 mil polyethylene terephthalate film and dried in an oven to give a dry coating thickness of 4 g/m$^2$.

Most of the reagents used in the experimental section were commercially available. The vinylpyridines and 1-vinylimidazole were obtained either from Aldrich Chemical Company (Milwaukee, Wis.) or from Reilly Chemical Company (Indianapolis, Ind.). The 4-methyl-4'-vinylbipyridine was prepared by a literature procedure (Abruna, H. A.; Breikss, A. I.; Collum, D. B. Inorg. Chem. 1985, 24, 988–989. 3-(3-pyridyl)propyl methacrylate was prepared by a standard procedure. The azo dye, 2,2'-dihydroxyazobenzene was purchased from Kodak Chemical Company (Rochester, N.Y.). The rest of the azo dyes were prepared by standard procedures well-known in the art, see for example, Brady, P. R.; Cookson, P. G.; Fincher, K. W.; Lewis, D. M. J. Soc. Dyers Colour. 1982, 98, 398–403.

The metal dye complexes were characterized by at least one of the following physical methods: UV-Visible spectroscopy, FT-IR spectroscopy, NMR spectroscopy, mass spectroscopy, laser desorption mass spectroscopy, elemental analysis, and differential scanning calorimetry.

EXAMPLE 1

This example describes the preparation of [[2,2'-azobis[phenolato]](−2)-N,O,O'](4-ethenylpyridine)-nickel (1). 2,2'-Dihydroxyazobenzene (1.0 g, 4.7 mmol), nickel(II) chloride hexahydrate (1.0 g, 4.2 mmol), sodium ethoxide (0.60 g, 8.8 mmol), and ethanol (75 ml) were placed in a 125 ml Erlenmeyer flask. The mixture was stirred for 3 hr at room temperature at which time 4-vinylpyridine (1 ml, 9.3 mmol) was added. The resultant mixture was stirred overnight. The crystals were washed with ethanol (200 ml) to yield 1 which was purified by repeated recrystallization from dichloromethane/heptane; m.p. 162° C.; $\lambda_{max}$ (acetone): 508 nm ($\epsilon$=12,300M$^{-1}$ cm$^{-1}$).

EXAMPLE 2

This example describes the preparation of [[2,2'-azobis[phenolato]](−2)-N,O,O'](4-ethenylpyridine)palladium (2). A solution containing 2,2'-dihydroxyazobenzene (1.07 g, 5.0 mmol) in 50 ml of dimethyl sulfoxide at 100° C. was added to a hot (100° C.) solution of potassium tetrachloropalladate (1.96 g, 6 mmol) in 50 ml of dimethyl sulfoxide. After addition of potassium carbonate (2.00 g, 14.5 mmol), the mixture was heated to 150° C. for 10 min and then allowed to cool to 100° C. At this time, 4-vinylpyridine (1.0 ml, 9.3 mmol) was added. The solution was removed from the hot plate and placed on a stirrer and let sit overnight. The solution was filtered to remove excess potassium carbonate and some dark solids. The filtrate was diluted with water to induce precipitation. The solid was collected, dissolved in dichloromethane, and treated with magnesium sulfate. Methanol was added and the solvent volume further reduced to afford 2 as a crystalline solid; m.p. 184.5° C.; $\lambda_{max}$ (dichloromethane): 512 nm.

EXAMPLE 3

This example describes the preparation of [[2,2'-azobis[phenolato]](−2)-N,O,O'](4-ethenylpyridine)-platinum (3). This procedure is the same as for [[2,2'-azobis[phenolato]](−2)-N,O,O'](4-ethenylpyridine)palladium, except potassium tetrachloroplatinate (1.73 g, 4.2 mmol) was used and 2 ml of vinylpyridine was added; m.p. 157.6° C.; $\lambda_{max}$ (dichloromethane): 480 nm.

EXAMPLE 4

This example describes the preparation of aqua[[2,2'-azobis[phenolato]](−2)-N,O,O'](2,4-pentanedionato-O,O')chromium (4). In a 200 ml round bottom flask were placed 2,2'-dihydroxyazobenzene (4.28 g, 20.0 mmol), chromium(III) acetate monohydrate (19.94 g, 80.6 mmol), 2,4-pentanedione (20.6 ml, 200.0 mmol), and 80 ml of N,N-dimethylformamide. The stirred dark yellow-green reaction mixture was then refluxed for 1 hr. The resulting deep red-purple solution was cooled to 25° C. and then poured into 400 ml of distilled water containing several drops of concentrated sulfuric acid. The resulting red-purple solid was collected by filtration, washed several times with distilled water, and then dried in a vacuum oven at ca. 40° C. To the crude reaction product was added ca. 300 ml of acetone and then the acetone was reduced in volume to ca. 125 ml by distillation. The solution was cooled to 25° C. followed by cooling to 0° C. to afford 4.15 g (54%) of compound 4 which was recrystallization from a mixture of hot acetone/methanol/toluene (5:1:1); $\lambda_{max}$ (methanol): 540, 514, 440 nm.

EXAMPLE 5

This example describes the preparation of aqua[2-[[(4,6-dimethoxy-2-hydroxyphenyl)imino]methyl]-4-nitrophenolato-N,O,O'](2,4-pentanedionato-O,O')-chromium (5). Compound 5 was prepared using procedures described in U.S. Pat. No. 3,597,200. In a 250 ml two-neck flask equipped with a Dean-Stark trap and reflux condenser were placed chromium(III) chloride hexahydrate (4.00 g, 0.015 mol), 40 ml of N,N-dimethylformamide, and 50 ml of toluene. The contents of the flask were heated with separation of water as a toluene/water azeotrope. Next 100 ml of isopropanol was added followed by heating to remove the toluene as a isopropanol/toluene azeotrope. After approximately 150 ml of distillate was collected, the flask was cooled and 2-hydroxy-4,6-dimethoxybenzald-(2'-hydroxy-5-nitrophenyl)imine (4.77 g, 0.015 mol) was added. The reaction mixture was then heated at 90° C. for 15 hr. The solution was cooled to 60° C. and 2,4-pentanedione (1.54 ml, 0.015 mol) and tri-n-butylamine (3.57 ml, 0.015 mol) were added and heating was continued for another 2.5 hr. The mixture was cooled and then poured into a total of 800 ml of distilled water containing several drops of concentrated hydrochloric acid. The resulting yellow-brown solid was dried in vacuo to afford 4.78 g of compound 5 (58% yield); $\lambda_{max}$ (methanol): 460, 435, 405, 380, 321, 309 nm.

EXAMPLE 6

This example describes the preparation of [[2,2'-azobis[phenolato]](−2)-N,O,O'](4-ethenyl-pyridine)(2,4-pentanedionato-O,O')chromium (6). In a 100 ml round bottom flask were placed compound 4 (1.14 g, 3.0 mmol) and 70 ml of methylene chloride. To this stirred solution was added 4-vinylpyridine (1.61 ml, 15.0 mmol). The progress of the reaction could be conveniently followed by thin layer chromatography on silica gel using an eluent mixture of 75% methylene chloride, 20% hexane, 5% acetone. After stirring for 4 hr the reaction solvent was removed under vacuum to afford a dark red-purple oil. This oil was triturated by adding several portions of hexane and scraping the sides of the flask. The resulting brown solid was collected by filtration and dried under vacuum to afford 1.08 g (77% yield) of compound 6. An analytical sample, containing one-half molecule of methylene chloride solvate, was obtained by several recrystallizations from hot dichloromethane/hexane; m.p. 195° C.; $\lambda_{max}$ (methanol): 550, 525, 450 nm.

EXAMPLE 7

This example describes the preparation of [[2,2'-azobis[phenolato]](−2)-N,O,O'](2,4-pentanedionato-O,O')[3-(3-pyridinyl)propyl 2-methyl-2-propenoate- N]chromium (7). In a 100 ml round bottom flask were placed compound 4 (0.500 g, 1.31 mmol) followed by 40 ml of dichloromethane. To this stirred solution was added 3-(3-pyridyl)propyl methacrylate (1.35 g, 6.6 mmol) and stirring was continued at 25° C. for 5.5 hr. The solvent was then removed under vacuum to afford a dark purple oil. This oil was triturated to a red-purple oily solid by the addition of several portions of hexane with vigorous scraping. An analytical sample was obtained by several recrystallizations from cold dichloromethane/heptane; m.p. 84° C.

EXAMPLE 8

This example describes the preparation of [6-[[(2-hydroxy-5-nitrophenyl)imino]methyl]-3,5-dimethoxyphenolato-N,O,O'](4-ethenylpyridine)(2,4-pentanedionato-O,O')chromium (8). In a 50 ml round bottom flask were placed compound 5 (0.666 g, 1.4 mmol) followed by 25 ml of methylene chloride. To this solution was added 4-vinylpyridine (0.74 ml, 6.8 mmol) with continued stirring for 12 hr. The progress of this reaction could also be conveniently followed by thin layer chromatography. The reaction solvent was then removed under vacuum and the resulting residue washed with two portions of petroleum ether. Drying the sample under vacuum afforded 0.776 g (98% yield) of compound 8 as a red-brown solid which was recrystallized from hot methylene chloride/hexane; m.p. 230° C. (dec); $\lambda_{max}$ (methanol): 439 nm ($\epsilon$=14,100M$^{-1}$ cm$^{-1}$), 405 nm ($\epsilon$=14,700M$^{-1}$ cm$^{-1}$), 381 nm ($\epsilon$=14,600M$^{-1}$ cm$^{-1}$), 323 nm ($\epsilon$=14,600M$^{-1}$ cm$^{-1}$).

EXAMPLE 9

This example describes the preparation of [[2,2'-azobis[phenolato]](−2)-N,O,O'](1-ethenyl-1H-imidazole-N$^3$)nickel(9). In a 250 ml Erlenmeyer flask were placed 2,2'-dihydroxyazobenzene (2.0 g, 9.4 mmol), nickel(II) chloride hexahydrate (2.0 g, 8.4 mmol), sodium ethoxide (1.2 g, 17.6 mmol) and ethanol (150 ml). The solution was stirred for 4 hr and then 1-vinylimidazole (2.08 g, 22 mmol) was added. The reaction mixture was stirred overnight where upon a dark crystalline material formed. The solid was purified by repeated recrystallization from dichloromethane/methanol; m.p. 182° C.; $\lambda_{max}$ (dichloromethane): 507 nm.

EXAMPLE 10

This example describes the preparation of (1-ethenyl-1H-imidazole-N$^3$)[1-[(2-hydroxy-4-methylphenyl)azo]-2-naphthalenolato(−2)]nickel (10). Compound 10 was prepared as in Example 2, except 1-[(2-hydroxy-4-methylphenyl)azo]-2-naphthol (2.0 g, 7.2 mmol), was used in place of 2,2'-dihydroxyazobenzene; m.p. 162° C.; $\lambda_{max}$ (dichloromethane): 538 nm.

EXAMPLE 11

This example describes the preparation of (4-ethenylpyridine) [1-[(2-hydroxyphenyl)azo]-2-naphthalenolato(−2)]nickel (11). Compound 11 was prepared as in Example 1, except 1-(2-hydroxyphenyl)azo-2-naphthol (1.0 g, 3.8 mmol) was used in place of 2,2'-dihydroazobenzene; m.p. 186° C.; $\lambda_{max}$ (acetone): 536 nm ($\epsilon$=19,200M$^{-1}$ cm$^{-1}$).

EXAMPLE 12

This example describes the preparation of [1-[(5-chloro-2-hydroxyphenyl)azo]-2-naphthalenolato(−2)](4-ethenylpyridine)nickel (12). Compound 12 was prepared as in Example 1, except 1-(2-hydroxy-5-chlorophenyl)azo-2-naphthol was used in place of 2,2'-dihydroxyazobenzene; m.p. 253° C.; $\lambda_{max}$ (acetone): 545 nm ($\epsilon$=18,500M$^{-1}$ cm$^{-1}$).

EXAMPLE 13

This example describes the preparation of [2,4-dihydro-4-[(2-hydroxyphenyl)azo]-5-methyl-2-phenyl-3H-pyrazol-3-onato (−2)](4-ethenylpyridine)nickel (13). A 125 ml Erlenmeyer flask was charged with 1-phenyl-3-methyl-4-(2-hydroxyphenyl)azo-5-pyrazolone (1.0 g 3.4 mmol) and 33 ml of dimethyl sulfoxide. This mixture was heated with stirring to 50° C. for 0.5 hr, the undissolved solids (0.05 g) were removed by filtration. Nickel(II) acetate tetrahydrate (1.0 g, 4.0 mmol) was added to the filtered solution and the mixture reheated to 50° C. with stirring for an additional 0.5 hr. 4-vinylpyridine (0.98 g, 9.3 mmol) was added and the mixture was stirred without heating for 2.0 hr. Water was added to induce precipitation. The solid was collected by filtration, extracted with dichloromethane, dried over magnesium sulfate. After filtering the magnesium sulfate off, heptane was added and the solvent volume reduced by evaporation on a hot plate. Dark green crystals were recovered (0.62 g). A second crop, not weighed could be subsequently isolated. Repeated crystallization from dichloromethane/heptane resulted in analytically pure material; m.p. 228° C.; $\lambda_{max}$ (acetone): 453 ($\epsilon$=17,600M$^{-1}$ cm$^{-1}$).

EXAMPLE 14

This example describes the preparation of [[2,2'-azobis[phenolato]](−2)-N,O,O'](2-ethenylpyridine)-nickel (14). Compound 14 was prepared as in Example 1, except 2-vinylpyridine was used in place of 4-vinylpyridine; $\lambda_{max}$ (dichloromethane): 509 nm.

EXAMPLE 15

This example describes the preparation of [[2,2'-azobis[phenolato]](−2)-N,O,O'](4'-ethenyl-4-methyl[2,2'-bipyridine]-N,N')nickel (15). In a 125 ml Erlenmeyer flask were placed 2.2'-dihydroxyazobenzene (0.56 g, 2.6 mmol), nickel(II) acetate tetrahydrate (0.56 g, 2.3 mmol), sodium ethoxide (0.35, 5.1 mmol), and 75 ml of ethanol. The mixture was heated to 50° C. with stirring for 1.0 hr. The solution was filtered to remove any solids, then 4-vinyl-4'-methylbipyridine (0.53 g, 2.8 mmol) was added. A red-brown microcrystalline solid was immediately formed; stirring was continued overnight. The solid was collected by filtration and dried in a vacuum oven at room temperature. The solid was recrystallized from hot dichloromethane; $\lambda_{max}$ (dichloromethane): 491 nm.

EXAMPLE 16

This example describes the preparation of [[2,2'-azobis[phenolato]](−2)-N,O,O'](pyridine)nickel (16). A mixture of nickel(II) chloride hexahydrate (1.0 g, 4.2 mmol), sodium ethoxide (0.60 g, 8.8 mmol), and 2,2'-dihydroxyazobenzene (1.0 g, 4.7 mmol) in 75 ml of ethanol were stirred for 4 hr. At this point, pyridine (2 ml) was added and the mixture allowed to stir overnight. The dark crystalline solid was collected on a sintered glass funnel and was recrystallized from dichloromethane/heptane; m.p 205° C.; $\lambda_{max}$ (acetone): 508 nm ($\epsilon$=14,200M$^{-1}$ cm$^{-1}$).

EXAMPLE 17

This example describes the preparation of [[2,2'-azobis[phenolato]](−2)-N,O,O'](triphenylphosphine)-nickel (17). Compound 17 was prepared as in Example 16, except triphenylphosphine was used in place of pyridine; m.p. 221° C.; $\lambda_{max}$ (dichloromethane): 507 nm.

EXAMPLE 18

This example describes the preparation of [[2,2'-azobis[phenolato]](−2)-N,O,O'](2,4-pentanedionato-O,O')(pyridine)chromium (18). In a 100 ml round bottom flask were placed compound 4 (1.14 g, 3.0 mmol) followed by 75 ml of methylene chloride. To this stirred solution was added pyridine (1.20 ml, 15.0 mmol). The progress of the reaction could be conveniently followed by thin layer chromatography on silica gel using an eluent mixture of 75% methylene chloride, 20% hexane, 5% acetone. After stirring for 5.5 hr the reaction solvent was removed under vacuum and the resulting residue washed extensively with hexane. The sample was dried under vacuum to afford 1.08 g (81% yield) of compound 18 which was recrystallized from hot toluene; m.p. 260° C.; $\lambda_{max}$ (methanol): 552 nm ($\epsilon$=10,250M$^{-1}$ cm$^{-1}$), 525 nm ($\epsilon$=10,550M$^{-1}$ cm$^{-1}$), 450 nm ($\epsilon$=7,350M$^{-1}$ cm$^{-1}$).

EXAMPLE 19

This example describes the preparation of [[2,2'-azobis[phenolato]](−2)-N,O,O'](4-ethylpyridine)(2,4-pentanedionato-O,O')chromium (19). In a 100 ml round bottom flask were placed compound 4 (0.57 g, 1.5 mmol) and 35 ml of methylene chloride. To this stirred solution was added 4-ethylpyridine (0.86 ml, 7.5 mmol). After stirring for 4 hr the reaction solvent was removed under vacuum to afford a deep-purple oil. This oil was triturated by adding several portions of hexane and scraping the sides of the flask. The resulting red-purple solid was dried under vacuum to afford 0.48 g (68% yield) of compound 19. An analytical sample, containing one-quarter molecule of methylene chloride solvate, was obtained by several recrystallizations from hot methylene chloride/hexane; m.p. 207° C.

EXAMPLE 20

This example describes the preparation of [[2,2'-azobis[phenolato]](−2)-N,O,O'](ethyl nicotinate)(2,4-pentanedionato-O,O')chromium (20). In a 100 ml round bottom flask were placed compound 4 (0.70 g, 1.8 mmol) followed by 50 ml of methylene chloride. To this stirred solution was added ethylnicotinate (0.74 ml, 5.4 mmol). After stirring for 16 hr the reaction solvent was removed under vacuum to afford a red-purple oil. This oil was triturated by adding several portions of hexane and scraping the sides of the flask. The resulting solid was recrystallized from hot methylene chloride/hexane to afford 0.91 g (98% yield) of compound 20; m.p. 119°-122° C.; $\lambda_{max}$ (methanol): 545, 525, 455 nm.

EXAMPLE 21

This example describes the preparation of [[2,2'-azobis[phenolato]](−2)-N,O,O'](3-hydroxymethyl-pyridine)(2,4-pentanedionato-O,O')chromium (21). In a 100 ml round bottom flask was placed compound 4 (0.50 g, 1.3 mmol). The flask was sealed with a septum and flushed well with nitrogen. Through a cannula was transferred 30 ml anhydrous methylene chloride under nitrogen. To this stirred solution was next added 3-pyridylcarbinol (0.32 ml, 3.3 mmol) via a syringe. After stirring for 16 hr under a nitrogen atmosphere the reaction solvent was removed under nitrogen to provide a red-purple oil. This oil was triturated with several portions of a mixture of toluene and hexane. The resulting solid was dried under vacuum to afford 0.42 g (69% yield) of compound 21 which was recrystallized from hot methylene chloride/toluene; m.p. 205°-208° C.

EXAMPLE 22

This example describes the preparation of [6-[[(2-hydroxy-5-nitrophenyl)imino]methyl]-3,5-dimethoxy-phenolato-N,O,O'](2,4-pentanedionato-O,O')-(pyridine)chromium (22). In a 50 ml round bottom flask were placed compound 5 (0.728 g, 1.5 mmol) followed by 30 ml of methylene chloride. To this solution was added pyridine (0.61 ml, 7.5 mmol) with continued stirring for 5 hr. The reaction solvent was removed under vacuum and the resulting residue washed with two portions of petroleum ether. Drying the sample under vacuum afforded 0.803 g (98% yield) of compound 22 as a red-brown solid. An analytical sample, containing one molecule of methylene chloride solvate, was obtained by several recrystallizations from hot methylene chloride/heptane; m.p. 292° C.; $\lambda_{max}$ (methanol): 450, 405, 385, 322 nm.

EXAMPLE 23

This example describes the preparation of (3-butyl-pyridine)[2-[[(4,6-dimethoxy-2-hydroxyphenyl)imino]-methyl]-4-nitrophenolato-N,O,O'](2,4-pentanedionato-O,O')chromium (23). In a 100 ml round bottomed flask were place compound 5 (0.50 g, 1.0 mmol) and 25 ml of methylene chloride. To this stirred solution was added 3-n-butylpyridine (0.76 ml, 5.2 mmol). After stirring overnight the reaction solvent was removed under vacuum to afford a brown oil. This oil was triturated by adding several portions of hexane and scraping the sides of the flask. The resulting yellow-brown solid was dried in vacuo afford 0.52 g (88% yield) of compound 23 which was recrystallized from hot absolute ethanol; m.p. 235° C.;

EXAMPLE 24

This example describes the preparation of [[2,2'-azobis[phenolato]](−2)-N,O,O'][8-quinolinolato-N$^1$,O$^8$](pyridine) (24). Compound 24 was prepared by modifying procedures described in U.S. Pat. No. 4,617,382. In a 200 ml round bottom flask were placed 2,2'-dihydroxyazobenzene (4.28 g, 20.0 mmol), chromium(III) chloride hexahydrate (7.46 g, 28.0 mmol), 8-hydroxyquinoline (4.65 g, 32.0 mmol), and 80 ml of dimethylformamide. The reaction mixture was heated to reflux for 1 hr, subsequently cooled to 25° C., and then poured into 400 ml of distilled water. The resulting dark red-purple precipitate was collected, washed with several portions of distilled water, and then dried in a vacuum drying oven to afford a compound of the formula:

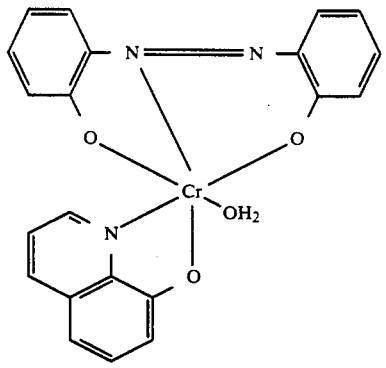

In a 50 ml round bottom flask were placed the above compound (0.60 g) followed by 30 ml of acetone. To this stirred solution was added pyridine (0.57 ml, 7.0 mmol). After stirring for 7 hr the reaction solvent was removed under vacuum to give a gummy solid. This solid was washed several times with hexane and then dried under vacuum. Analysis of this material by thin layer chromatography on silica gel using 15% acetone/85% methylene chloride as the eluent indicated the presence of at least eight compounds ranging in $R_f$ values from 0.0 to 0.78. The major compound from this reaction mixture, which exhibited a deep-purple spot with an $R_f$ value of 0.27 (silica gel, 15% acetone/85% methylene chloride), was isolated by column chromatography on silica gel using 15% acetone/85% methylene chloride as the eluting solvent. The fractions exhibiting a single spot with an $R_f$ value of ca. 0.30 (silica gel, 15% acetone/85% methylene chloride) were combined and the solvent removed under vacuum to afford compound 24 which was further purified by several recrystallizations from hot methylene chloride/hexane; m.p. 264° C. (dec).

EXAMPLE 25

This example describes the preparation of [1-[(2-hydroxyphenyl)azo]-2-naphthalenolato(−2)]-(pyridine)nickel (25). Compound 25 was prepared according to Example 16, except that 1-[(2-hydroxyphenyl)azo]-2-naphthol was used in place of 2,2'-dihydroxyazobenzene; m.p. 202° C.; $\lambda_{max}$ (acetone): 536 nm ($\epsilon$=18,300$M^{-1}$ $cm^{-1}$).

EXAMPLE 26

This example describes the preparation of [1-[(5-chloro-2-hydroxyphenyl)azo]-2-naphthalenolato(−2)]-(pyridine)nickel (26). Compound 26 was prepared according to Example 16, except that 1-[(2-hydroxy-5-chlorophenyl)azo]-2-naphthol was used in place of 2,2-dihydroxyazobenzene; m.p. 260° C.; $\lambda_{max}$ (acetone): 545 nm ($\epsilon$=17,400$M^{-1}$ $cm^{-1}$).

EXAMPLE 27

This example describes the construction of donor sheet A. The donor sheet was prepared from the following formulation:

0.06 g dye
0.035 g Goodrich Geon TM 178 polyvinyl chloride (PVC), available from BF Goodrich, Geon Vinyl Division (Cleveland, Ohio.)
0.0025 g Goodyear Vitel TM polyester 200, available from Goodyear Chemicals (Akron, Ohio.)
0.014 g RD 1203 (60/40 blend of octadecyl acrylate and acrylic acid, 3M Company, St. Paul, Minn.)
0.014 g Troy CD 1 (chemical registry Abstracts Service Number: 64742-88-7), available from Troy Chemical (Newark, N.J.)
0.372 g 2-butanone
2.653 g tetrahydrofuran

EXAMPLE 28

This example describes the construction of donor sheet B. The donor sheet was prepared from the same formulation as shown in Example 27, except that cellulose acetate butyrate (CAB-551, Eastman Chemical Products, Inc., Kingsport, Tenn.) was used instead of Goodrich Geon TM 178 poly(vinyl chloride).

EXAMPLE 29

This example describes the construction of receptor sheet A. The receptor sheet was made from the following formulation:

2.89 wt % ICI Atlac TM 382ES bisphenol A fumarate polyester, available from ICI Americas (Wilmington, Del.) 2.33 wt % Goodrich Temprite TM 678×512 62.5% chlorinated polyvinyl chloride (CPVC)
0.47 wt % Shell Epon TM 1002 epoxy resin, available from Shell Chemical (Oakbrook, Ill.)
0.47 wt % Goodyear Vitel TM PE 200 polyester
0.58 wt % 3M Fluororad TM FC 430 fluorocarbon surfactant, available from 3M Company, Industrial Chemical Products Division (Saint Paul, Minn.)
0.17 wt % Ciba-Geigy Tinuvin TM 328 UV stabilizer, available from Ciba-Geigy Additives Department (Hawthorne, N.Y.)
0.29 wt % BASF Uvinul TM N539 UV stabilizer, available from BASF Wyandotte, Uvinul Department (Parsippany, N.J.)
0.58 wt % Ferro Therm-Check TM 1237 heat stabilizer, available from Ferro Corporation, Chemical Division (Bedford, Ohio.)
0.93 wt % Eastman Kodak DOBP TM (4-dodecyloxy-2-hydroxybenzophenone, available from Eastman Chemical Products, Inc. (Kingsport, Tenn.))
25.17 wt % 2-butanone
66.12 wt % tetrahydrofuran

EXAMPLE 30

This example describes the preparation of receptor sheet B. Receptor sheet B was Dai Nippon Opaque receptor (Dai Nippon Printing, Japan) which was used as received, with dye transfer to the coated side.

EXAMPLE 31

This example describes the use of printer A. Thermal printer A used a Kyocera raised glaze thin film thermal print head with 8 dots/mm and 0.3 watts per dot. In normal imaging, the electrical energy varied from 0 to 14 joules/$cm^{-2}$, which corresponds to head voltages from 0 to 20 volts with a 4 to 23 msec pulse.

Dye donor and dye receptor sheets were assembled and imaged with the thermal print head with a burn time of 23 msec at 16.5 V, and a burn profile of K59(70–255 msec on /0–150 msec off). Eight levels of graduation were used.

The resulting image density (reflectance optical density) for each level of gradation was measured with a MacBeth TR527 densitometer (MacBeth Instrument Co., Newburgh, N.Y.).

EXAMPLE 32

This example describes the thermal transfer of dyes 2, 3, 7, 9, 11-15, 17, 19, 21-26 using donor sheet A and receptor sheet A. The results are summarized in Table I.

TABLE 1

| | | Image Density (Reflectance Optical Density) Measured at Level # | | | | | | | |
|---|---|---|---|---|---|---|---|---|---|
| Cpd. | Color | 1 | 2 | 3 | 4 | 5 | 6 | 7 | 8 |
| 2 | orange | 0.09 | 0.23 | 0.42 | 0.56 | 0.68 | 0.79 | 0.89 | 0.96 |
| 3 | yellow | 0.17 | 0.26 | 0.38 | 0.53 | 0.67 | 0.82 | 0.98 | 1.06 |
| 7 | dull magenta | 0.14 | 0.16 | 0.22 | 0.29 | 0.35 | 0.40 | 0.48 | 0.53 |
| 9 | brown | 0.17 | 0.34 | 0.56 | 0.78 | 0.98 | 1.18 | 1.38 | 1.53 |
| 11 | magenta | 0.09 | 0.19 | 0.32 | 0.40 | 0.48 | 0.56 | 0.65 | 0.69 |
| 12 | dark purple | 0.09 | 0.13 | 0.16 | 0.16 | 0.22 | 0.27 | 0.25 | 0.28 |
| 13 | yellow | 0.05 | 0.11 | 0.16 | 0.21 | 0.25 | 0.30 | 0.36 | 0.41 |
| 14 | orange-brown | 0.13 | 0.22 | 0.36 | 0.50 | 0.62 | 0.71 | 0.77 | 0.78 |
| 15 | yellow-brown | 0.06 | 0.07 | 0.11 | 0.16 | 0.15 | 0.17 | 0.18 | 0.18 |
| 17 | yellow-brown | 0.16 | 0.18 | 0.25 | 0.34 | 0.45 | 0.52 | 0.62 | 0.72 |
| 19 | red-magenta | 0.13 | 0.21 | 0.31 | 0.40 | 0.48 | 0.55 | 0.65 | 0.71 |
| 21 | red-magenta | 0.14 | 0.21 | 0.25 | 0.32 | 0.36 | 0.40 | 0.46 | 0.48 |
| 22 | yellow | 0.10 | 0.16 | 0.21 | 0.26 | 0.33 | 0.36 | 0.42 | 0.46 |
| 23 | orange | 0.09 | 0.10 | 0.10 | 0.13 | 0.20 | 0.23 | 0.24 | 0.28 |
| 24 | dark red | 0.10 | 0.10 | 0.11 | 0.13 | 0.15 | 0.16 | 0.18 | 0.18 |
| 25 | dull red | 0.14 | 0.32 | 0.54 | 0.73 | 0.91 | 1.04 | 1.20 | 1.24 |
| 26 | magenta | 0.13 | 0.22 | 0.30 | 0.41 | 0.51 | 0.57 | 0.63 | 0.69 |

A 3% solution in THF could not be achieved due to insolubility of the dye.

EXAMPLE 33

This example describes the thermal transfer of dyes 2, 3, 7, 9, 11-15, 17, 19, 21-26 using donor sheet A and receptor sheet B. The results are summarized in Table 2.

TABLE 2

| | | Image Density (Reflectance Optical Density) Measured at Level # | | | | | | | |
|---|---|---|---|---|---|---|---|---|---|
| Cmpd | Color | 1 | 2 | 3 | 4 | 5 | 6 | 7 | 8 |
| 2 | orange | 0.11 | 0.26 | 0.45 | 0.65 | 0.70 | 0.88 | 0.98 | 1.08 |
| 3 | yellow-brown | 0.12 | 0.46 | 0.61 | 0.77 | 0.89 | 0.91 | 1.06 | 1.12 |
| 7 | dull magenta | 0.14 | 0.17 | 0.24 | 0.35 | 0.39 | 0.44 | 0.48 | 0.52 |
| 9 | brown | 0.20 | 0.46 | 0.74 | 0.96 | 1.18 | 1.37 | 1.51 | 1.63 |
| 11 | magenta | 0.13 | 0.24 | 0.37 | 0.50 | 0.61 | 0.69 | 0.75 | 0.79 |
| 12 | dark purple | 0.10 | 0.13 | 0.17 | 0.22 | 0.26 | 0.32 | 0.34 | 0.41 |
| 13 | yellow | 0.06 | 0.13 | 0.19 | 0.26 | 0.33 | 0.40 | 0.44 | 0.50 |
| 14 | orange-brown | 0.11 | 0.27 | 0.36 | 0.47 | 0.58 | 0.65 | 0.71 | 0.81 |
| 15 | yellow-brown | 0.04 | 0.10 | 0.15 | 0.18 | 0.19 | 0.20 | 0.20 | 0.22 |
| 17 | yellow-brown | 0.14 | 0.21 | 0.31 | 0.41 | 0.49 | 0.58 | 0.67 | 0.73 |
| 19 | red-magenta | 0.09 | 0.18 | 0.28 | 0.36 | 0.44 | 0.50 | 0.59 | 0.67 |
| 21 | red-magenta | 0.05 | 0.14 | 0.22 | 0.28 | 0.33 | 0.36 | 0.40 | 0.45 |
| 22 | yellow | 0.05 | 0.12 | 0.18 | 0.27 | 0.31 | 0.38 | 0.41 | 0.48 |
| 23 | orange | 0.04 | 0.08 | 0.12 | 0.15 | 0.18 | 0.23 | 0.26 | 0.31 |
| 24 | dark red | 0.05 | 0.07 | 0.10 | 0.14 | 0.18 | 0.19 | 0.22 | 0.23 |
| 25 | dull red | 0.20 | 0.41 | 0.68 | 0.86 | 1.02 | 1.18 | 1.26 | 1.35 |
| 26 | magenta | 0.15 | 0.27 | 0.40 | 0.49 | 0.60 | 0.67 | 0.73 | 0.80 |

A 3% solution in THF could not be achieved due to insolubility of the dye.

EXAMPLE 34

This example describes the thermal transfer of dyes 21, 22, 24 using donor sheet B and receptor sheet A. The results are summarized in Table 3.

TABLE 3

| | | Image Density (Reflectance Optical Density) Measured at Level # | | | | | | | |
|---|---|---|---|---|---|---|---|---|---|
| Cmpd | Color | 1 | 2 | 3 | 4 | 5 | 6 | 7 | 8 |
| 21 | red-magenta | — | — | 0.25 | 0.29 | 0.38 | 0.56 | 0.73 | 0.73 |
| 22 | yellow | — | 0.17 | 0.20 | 0.25 | 0.29 | 0.43 | 0.55 | 0.58 |
| 24 | dark red | 0.11 | 0.16 | 0.20 | 0.22 | 0.22 | 0.26 | 0.34 | 0.33 |

A 3% solution in THF could not be achieved due to insolubility of the dye.
— Indicates that thermal transfer was not possible.

EXAMPLE 35

This example describes the thermal transfer of dyes 2, 7, 9, 11, 12, 19, 21, 24, 25 using donor sheet B and receptor sheet B. The results are summarized in Table 4.

TABLE 4

| Cmpd | Color | Image Density (Reflectance Optical Density) Measured at Level # 1 | 2 | 3 | 4 | 5 | 6 | 7 | 8 |
|---|---|---|---|---|---|---|---|---|---|
| 2 | orange | 0.32 | 0.51 | 0.67 | 0.75 | 0.87 | 0.96 | 1.02 | 1.05 |
| 7 | dull magenta | 0.10 | 0.15 | 0.21 | 0.31 | 0.41 | 0.41 | 0.59 | 0.65 |
| 9 | brown | 0.17 | 0.44 | 0.82 | 1.10 | 1.23 | 1.40 | 1.49 | 1.51 |
| 11 | magenta | 0.21 | 0.39 | 0.61 | 0.74 | 0.85 | 1.02 | 1.10 | 1.17 |
| 12 | dark purple | 0.11 | 0.14 | 0.16 | 0.17 | 0.21 | 0.24 | 0.27 | 0.28 |
| 19 | red-magenta | 0.08 | 0.15 | 0.24 | 0.31 | 0.41 | 0.51 | 0.59 | 0.62 |
| 21 | red-magenta | 0.07 | 0.13 | 0.18 | 0.22 | 0.34 | 0.39 | — | — |
| 24 | dark red | 0.09 | 0.10 | 0.13 | 0.17 | 0.20 | 0.21 | 0.22 | 0.22 |
| 25 | dull red | 0.24 | 0.45 | 0.69 | 0.87 | 1.05 | 1.19 | 1.27 | 1.27 |

A 3% solution in THF could not be achieved due to insolubility of the dye.

— Indicates that thermal transfer was not possible.

EXAMPLE 36

This comparative example describes the dye transfer of dyes 6 and 18 with two commonly used organic magenta dyes using donor sheet A and receptor sheet A. The results are summarized in Table 5.

EXAMPLE 37

This comparative example describes the dye transfer of dye 20 with two commonly used organic magenta dyes using donor sheet A and receptor sheet A. The results are summarized in Table 6.

TABLE 5

| | | Image Intensity (R.O.D.) Level # 1 | 2 | 3 | 4 | 5 | 6 | 7 | 8 |
|---|---|---|---|---|---|---|---|---|---|
| 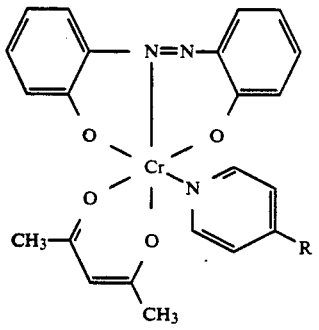 | R = H (18) | Poor Transfer due to low solubility | | | | | | | |
| | R = vinyl (6) | 0.09 | 0.14 | 0.21 | 0.29 | 0.38 | 0.44 | 0.53 | 0.63 |
| 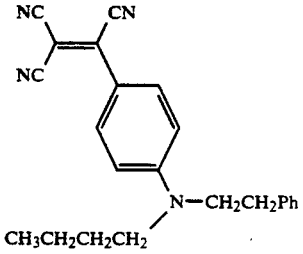 | (HSR-31) | 0.30 | 0.65 | 1.05 | 1.28 | 1.40 | 1.53 | 1.61 | 1.70 |
| 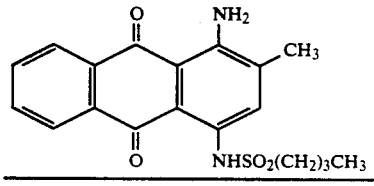 | (Butyl Magenta) | 0.12 | 0.29 | 0.45 | 0.60 | 0.79 | 0.97 | 1.11 | 1.23 |

TABLE 6

| Dye Structure | Image Density (R.O.D.) Measured at Level # 1 | 2 | 3 | 4 | 5 | 6 | 7 | 8 |
|---|---|---|---|---|---|---|---|---|
| 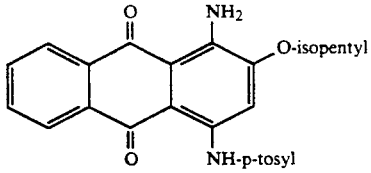 | 0.11 | 0.16 | 0.24 | 0.35 | 0.53 | 0.71 | 0.75 | 0.69 |
| 20 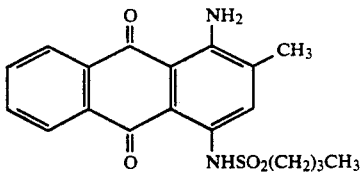 | 0.15 | 0.24 | Mass Transfer 0.38 | 0.58 | 0.89 | 0.79 1.23 | 0.94 1.43 | 1.03 1.46 |

EXAMPLE 38

This example describes the dye transfer of dye 8 using donor sheet A and receptor sheet A. The results are summarized in Table 7.

TABLE 7

| Dye Structure | Image Density (R.O.D.) Measured at Level # 5 | 6 | 7 | 8 |
|---|---|---|---|---|
| 8 | 0.23 | 0.27 | 0.30 | 0.33 |

EXAMPLE 39

This comparative example describes the light stability test of dyes 2, 3, 6, 19 with two commonly used organic magenta dyes. The dyes were respectively incorporated in a donor sheet prepared according to Example 27. They were then transferred to receptor sheet A in the same manner as described in Example 31. The resulting images were then tested for UV stability in an Atlas TM UVCON ($\lambda$=351 nm, 50° C., 72 hr). The results are summarized in Table 8.

TABLE 8

| Dye Structure | Dye Image Stability Initial R.O.D. | % Loss in R.O.D. |
|---|---|---|
| 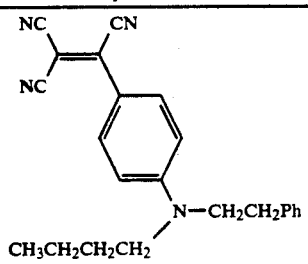 (HSR-31) | 1.32 | 32.5 |
| 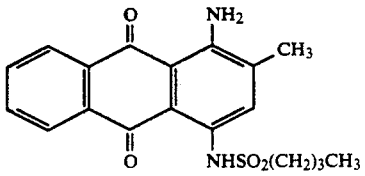 (Butyl Magenta) | 0.98 | 23.5 |

TABLE 8-continued

| Dye Structure | Dye Image Stability Initial R.O.D. | % Loss in R.O.D. |
|---|---|---|
| 2 | 1.08 | 5.6 |
| 3 | 1.25 | 19.2 |
| 6 | 0.75 | 15.5 |
| 18 | 0.54 | 17 |
| 19 | 0.82 | 20.7 |

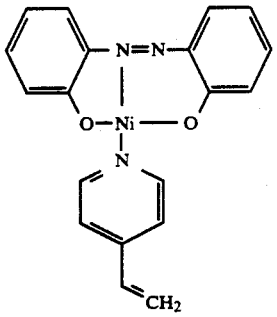

1

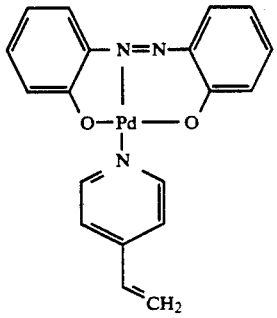

2

TABLE 8-continued
| Dye Structure | Dye Image Stability Initial R.O.D. | Dye Image Stability % Loss in R.O.D. |
|---|---|---|
| 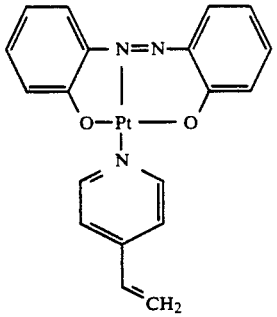 3 | | |
| 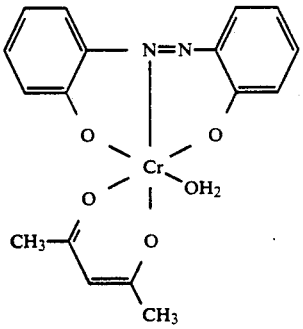 4 | | |
| 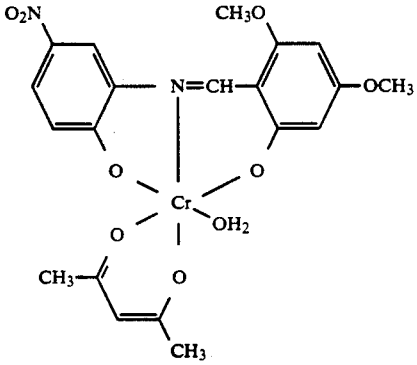 5 | | |
| 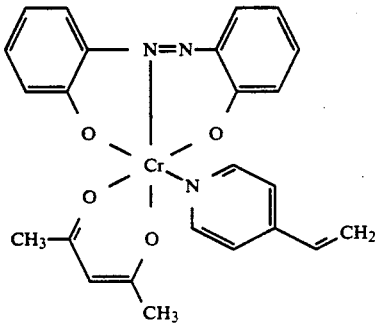 6 | | |
TABLE 8-continued
| Dye Structure | Dye Image Stability Initial R.O.D. | Dye Image Stability % Loss in R.O.D. |
|---|---|---|
| 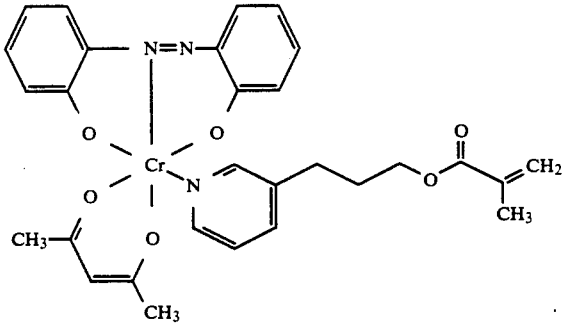 7 | | |
| 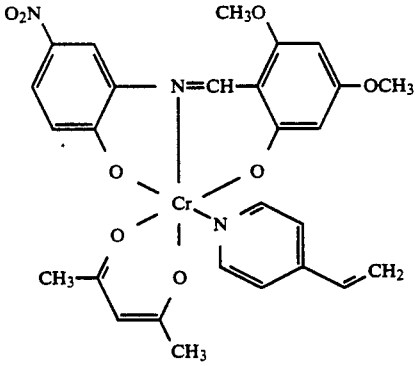 8 | | |
| 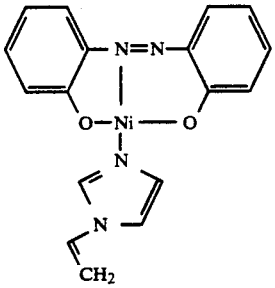 9 | | |
| 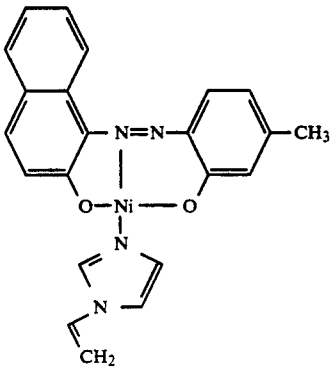 10 | | |

TABLE 8-continued
| Dye Structure | Dye Image Stability Initial R.O.D. | Dye Image Stability % Loss in R.O.D. |
|---|---|---|
| 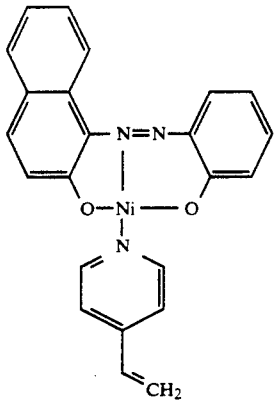 11 | | |
| 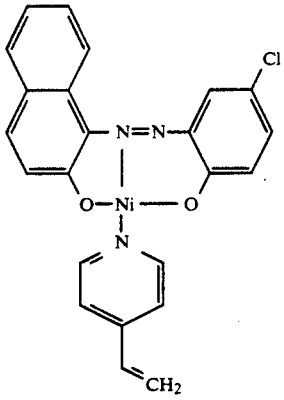 12 | | |
| 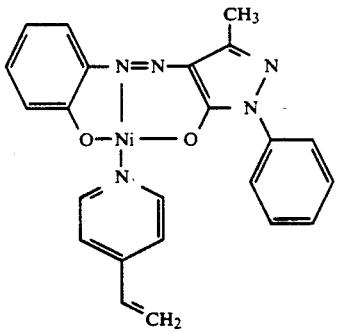 13 | | |
| 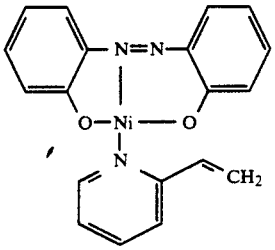 14 | | |
TABLE 8-continued
| Dye Structure | Dye Image Stability Initial R.O.D. | Dye Image Stability % Loss in R.O.D. |
|---|---|---|
| 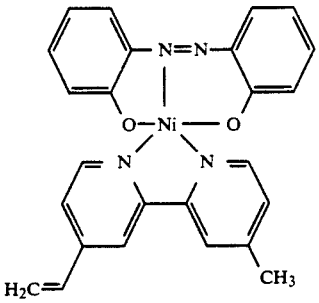 15 | | |
| 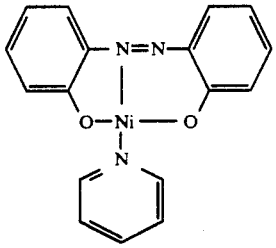 16 | | |
| 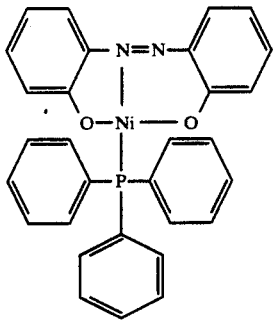 17 | | |
| 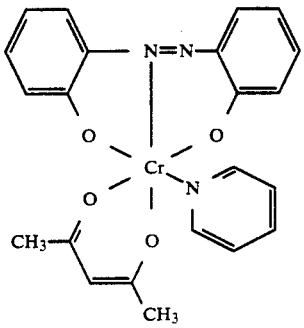 18 | | |

TABLE 8-continued
| Dye Structure | Dye Image Stability Initial R.O.D. | Dye Image Stability % Loss in R.O.D. |
|---|---|---|
| 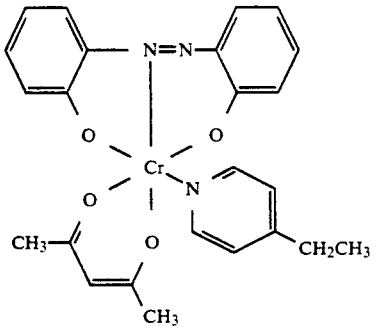 19 | | |
| 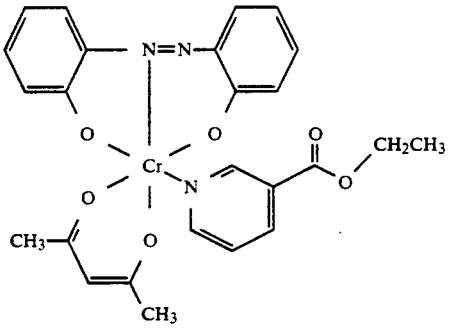 20 | | |
| 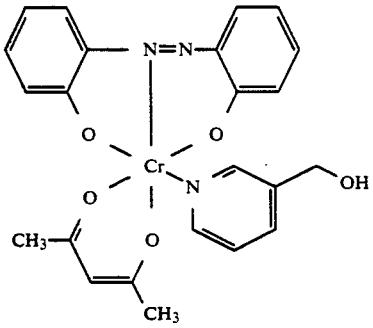 21 | | |
| 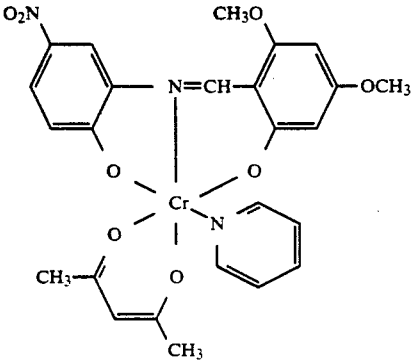 22 | | |
TABLE 8-continued
| Dye Structure | Dye Image Stability Initial R.O.D. | Dye Image Stability % Loss in R.O.D. |
|---|---|---|
| 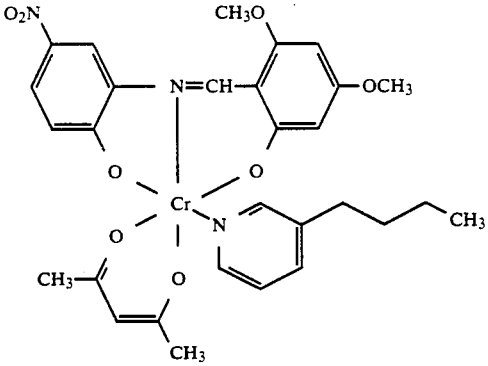 23 | | |
| 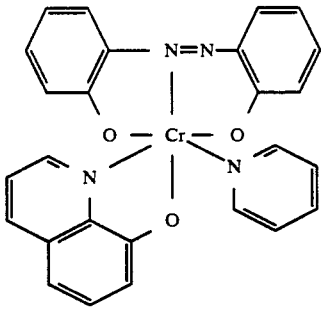 24 | | |
| 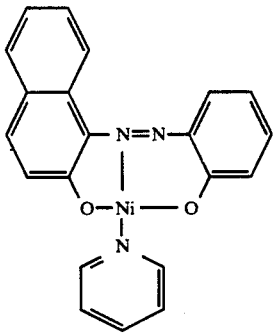 25 | | |
| 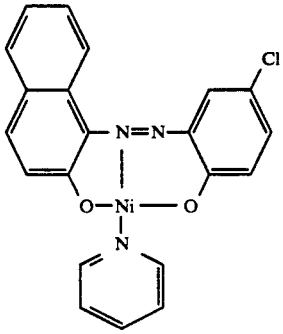 26 | | |
We claim:

1. A thermal transfer dye donor sheet comprising a substrate having a coating consisting essentially of at least one neutral 1:1 metalazo or neutral 1:1 metalazomethine dye having the general structure:

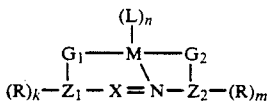

wherein $Z_1$ and $Z_2$ each independently represent an arene nucleus, having from 5 to 14 ring atoms;

$G_1$ and $G_2$ each independently represent a metal ligating group, and further wherein $G_1$ and $G_2$ may be contained within or pendant from at least one of $Z_1$ and $Z_2$;

R represents a hydrogen atom, a halogen atom, an alkyl group, an acylamino group, an alkoxy group, a sulfonamido group, an aryl group, a thiol group, an alkylthio group, an arylthio group, an alkylamino group, an arylamino group, an amino group, an alkoxycarbonyl group, an acyloxy group, a nitro group, a cyano group, a sulfonyl group, a sulfoxyl group, an aryloxy group, a hydroxy group, a thioamido group, a carbamoyl group, a sulfamoyl group, a formyl group, an acyl group, a ureido group, or aryloxycarbonyl group, a silyl group, a carbonato group, or a sulfoalkoxy group;

L is any combination of monodentate, bidentate, or tridentate ligands which satisfy the coordination requirements of the metal;

X represents nitrogen or a methine group;

M is a divalent or polyvalent transition metal where the coordination number is at least four; and k, m, and n are whole numbers less than or equal to 3.

2. A dye-donor sheet according to claim 1 further comprising a binder.

3. A dye-donor sheet according to claim 2 wherein said binder is nontransferrable.

4. A dye-donor sheet according to claim 1 wherein G, and $G_2$ independently represent hydroxy, carboxy, or a nitrogen atom which is part of Z, and $Z_2$.

5. A dye-donor sheet according to claim 1 wherein L is a nitrogen-containing heterocycle or tertiary phosphine.

6. A dye-donor sheet according to claim 1 wherein L is selected from the group consisting of pyridine, substituted pyridines, imidazole, and substituted imidazoles.

7. A dye-donor sheet according to claim 1 wherein L is selected from the group consisting of 4-vinyl pyridine or 1-vinyl imidazole.

8. A dye-donor sheet according to claim 1 wherein M is selected from the group consisting of chromium(III), nickel(II), palladium(II), and platinum(II).

9. A dye-donor sheet according to claim 8 wherein M is chromium(III).

10. A thermal dye transfer process which comprises the steps of:

(a) contacting the thermal transfer dye-donor sheet of claim 1 with a suitable receptor sheet; and (b) thereafter, applying heat in an imagewise fashion to said thermal transfer dye-donor sheet whereby the dye is thermally transferred to the receptor sheet.

11. A thermal dye transfer process according to claim 10 wherein said dye-donor sheet is heated to a temperature from about 100° C. to 400° C. for a period of about 1 to 10 milliseconds while in contact with the receptor sheet.

12. A thermal dye transfer process according to claim 10 wherein the receptor sheet is paper or transparent polyester film.

* * * * *